US011733654B2

(12) United States Patent
Jeanrenaud et al.

(10) Patent No.: US 11,733,654 B2
(45) Date of Patent: Aug. 22, 2023

(54) DISENGAGEMENT OF TWO GEAR TRAINS

(71) Applicant: Omega SA, Biel/Bienne (CH)

(72) Inventors: Timothee Jeanrenaud, Yverdon-les-Bains (CH); Bernat Monferrer, St-Prex (CH)

(73) Assignee: OMEGA SA, Biel/Bienne (CH)

( * ) Notice: Subject to any disclaimer, the term of this patent is extended or adjusted under 35 U.S.C. 154(b) by 538 days.

(21) Appl. No.: 16/926,021

(22) Filed: Jul. 10, 2020

(65) Prior Publication Data

US 2021/0063966 A1 Mar. 4, 2021

(30) Foreign Application Priority Data

Aug. 26, 2019 (EP) ..... 19193606

(51) Int. Cl.
*G04B 13/02* (2006.01)
*G04B 27/00* (2006.01)

(52) U.S. Cl.
CPC ..... *G04B 13/028* (2013.01); *G04B 13/026* (2013.01); *G04B 27/001* (2013.01); *G04B 27/004* (2013.01)

(58) Field of Classification Search
CPC ..... G04B 13/02; G04B 13/025
See application file for complete search history.

(56) References Cited

U.S. PATENT DOCUMENTS 3,645,090 A * 2/1972 Mochizuki ..... G04B 11/006 368/32
3,665,698 A 5/1972 Dome
3,775,966 A * 12/1973 Matsuura ..... G04B 27/04 368/32
3,798,893 A * 3/1974 Ippoushi ..... G04B 19/25 368/32
4,445,783 A 5/1984 Dodane
4,998,230 A * 3/1991 Fini ..... G04B 19/223 368/27

(Continued)

FOREIGN PATENT DOCUMENTS

CH 623980G A3 7/1981
JP 2005-300282 A 10/2005

OTHER PUBLICATIONS

European Search Report for EP 19193606 dated Feb. 14, 2020.

(Continued)

*Primary Examiner* — Daniel P Wicklund
(74) *Attorney, Agent, or Firm* — Sughrue Mion, PLLC

(57) ABSTRACT

A timepiece mechanism (100) for disengaging a gear train. The timepiece mechanism (100) includes a gear set (110), a disengagement member (120), a holding member (121) and a control member (130). The gear set (110) includes a first wheel (111), a second wheel (112) and an intermediate wheel (113) configured to be driven by or for driving the first wheel (111) and/or for driving the second wheel (112). The holding member (121) holds the first wheel (111) and/or the second wheel (112) when the disengagement member (120), controlled by the control member (130), moves the intermediate wheel (113) between an engaged position (101) and a disengaged position (102). Hence the timepiece mechanism (100) is held in position while disengaging the watch mechanism.

14 Claims, 2 Drawing Sheets

(56) References Cited

U.S. PATENT DOCUMENTS

| | | | | |
|---|---|---|---|---|
| 2006/0221771 | A1* | 10/2006 | Zimmermann | G04B 19/268 368/16 |
| 2016/0147198 | A1* | 5/2016 | Bravo | G04F 3/022 368/101 |
| 2017/0068223 | A1* | 3/2017 | Kruttli | G04B 11/00 |

OTHER PUBLICATIONS

Communication dated Jul. 13, 2021 by the China National Intellectual Property Administration in application No. 202010872612.5.

Communication dated Aug. 24, 2021 by the Japanese Patent Office in application No. 2020-126160.

* cited by examiner

DISENGAGEMENT OF TWO GEAR TRAINS

CROSS REFERENCE TO RELATED APPLICATIONS

This application claims priority to European Patent Application No. 19193606.1 filed Aug. 26, 2019, the entire contents of which are incorporated herein by reference.

TECHNICAL FIELD

The field of the present invention relates to horology and, more particularly, timepiece mechanisms enabling disengagement of a gear train.

TECHNOLOGICAL BACKGROUND

Timepiece mechanisms for disengaging a gear train are known from the prior art. However, a certain volume is required in order to perform this disengagement manoeuvre.

Indeed, depending on the techniques employed, the part to be unmeshed is moved in a space which is achievable in a simple watch. However, on the one hand, the task proves more delicate when the watch has a limited space.

On the other hand, it is not possible to disconnect a going-train mechanism from a display mechanism, for example, while holding one of the two in place.

SUMMARY OF THE INVENTION

The present invention proposes to fully or partially overcome these drawbacks to a timepiece mechanism for disengaging a gear train; said timepiece mechanism comprising at least:

- a gear set: said gear set comprising a first wheel, a second wheel and an intermediate wheel arranged between said first wheel and said second wheel; said intermediate wheel being configured to be driven by or for driving said first wheel and/or said second wheel;
- a disengagement member: said at least one disengagement member being configured to move said intermediate wheel in a movement plane between an engaged position in which said first wheel, said intermediate wheel and said second wheel are kinematically connected and a disengaged position in which said intermediate wheel is unmeshed from said first wheel and/or from said second wheel;
- a holding member: said at least one holding member being configured to hold said first wheel and/or said second wheel; and,
- a control member; said at least one control member being configured to move said at least one disengagement member between said engaged position and said disengaged position and to move said at least one holding member into contact and to hold said first wheel and/or said second wheel when said at least one disengagement member is in the disengaged position.

Through this arrangement, it is possible to hold the timepiece mechanism in position while disengaging the watch mechanism. Furthermore, the intermediate wheel can be in motion and in contact with the first wheel while being disengaged from the second wheel, or vice versa, which makes it possible to avoid tooth-to-tooth contact during engagement, because the intermediate wheel continues to move through this arrangement. Indeed, this timepiece mechanism makes it possible to disconnect to gear trains while holding one.

According to an embodiment, said first wheel and/or said second wheel comprises a friction surface and preferably a toothing and/or a peripheral surface.

According to an embodiment, said first wheel is a first disc or comprises at least one first pinion and/or said second wheel is a second disc or comprises at least one second pinion; said at least one first pinion and/or said at least one second pinion being configured to or are configured to drive said intermediate wheel.

Through this arrangement, it is possible to transmit the movement to the intermediate wheel and preferably the rotary movement to the intermediate wheel.

According to an embodiment, said at least one disengagement member comprises at least one actuating arm; said at least one control member is configured to move said at least one disengagement member by means of said at least one actuating arm.

According to an embodiment, said at least one actuating arm is configured to move said at least one disengagement member between said engaged position and said disengaged position.

Through this arrangement, it is possible to actuate the disengagement member while being remote from the control member.

According to an embodiment, said at least one disengagement member comprises at least one first flexible arm; said at least one flexible arm is configured to connect said at least one holding member to said at least one disengagement member.

According to an embodiment, said at least one first flexible arm protrudes overhanging said at least one disengagement member and comprising said at least one holding member provided with a holding surface; said holding surface is configured to cooperate with said friction surface and preferably with said toothing and/or said peripheral surface of said first wheel and/or of said second wheel.

According to an embodiment, said at least one first flexible arm protrudes overhanging said at least one disengagement member and comprising said at least one holding member provided with a holding surface; said holding surface is configured to cooperate with a friction surface and preferably with a toothing and/or a peripheral surface of said first wheel and/or of said second wheel.

According to an embodiment, the holding of said first wheel and/or of said second wheel by said holding surface is performed by friction or lubricated friction.

Through this arrangement, it is possible to hold the wheels by friction or rubbing while allowing the user a manual correction or to set the time without breaking a part.

According to an embodiment, said at least one first flexible arm is a return member configured to return the holding member to its position.

Through this arrangement, it is possible to hold the first wheel and/or the second wheel without blocking the first wheel and/or the second wheel. Indeed, the first flexible arm acts as a spring according to the embodiment.

According to an embodiment, said at least one first flexible arm is configured to move said at least one holding member into contact with the first wheel and/or with the second wheel.

Through this arrangement, the first flexible arm brings the holding member into contact with the first wheel and/or with the second wheel.

According to an embodiment, said at least one first flexible arm is configured so as to deform elastically.

According to an embodiment, said at least one disengagement member it is mounted to pivot about a pivot axis According to an embodiment, said at least one disengagement member is configured to pivot about said pivot axis so as to move between said engaged position and said disengaged position.

According to an embodiment, said at least one disengagement member is configured to pivot about said pivot axis so as to move said at least one holding member into contact with said holding surface.

According to an embodiment, said at least one disengagement member is at least one lever configured to pivot about said pivot axis so as to move said at least one holding member into contact with said holding surface.

Through this arrangement, the disengagement member is mounted to pivot about a pivot axis.

According to an embodiment, said intermediate wheel is arranged on said at least one disengagement member and is preferably mounted to pivot on a return axis.

According to an embodiment, said return axis is separate and/or remote from the pivot axis.

Through this arrangement, the intermediate wheel can be moved between said engaged position and said disengaged position when the disengagement member is moved.

According to an embodiment, said intermediate wheel is arranged between said pivot axis and said at least one actuating arm.

Through this arrangement, the intermediate wheel can be moved between said engaged position and said disengaged position when the disengagement member is moved.

According to an embodiment, said at least one control member is configured to move between at least one first position and at least one second position and comprises a stud; said stud being configured to abut and move said at least one actuating arm so as to move said at least one disengagement member from said engaged position to said disengaged position when said stud moves from said at least one first position to said at least one second position and/or wherein said at least one disengagement member comprises at least one second flexible arm; said at least one second flexible arm being configured to move said at least one disengagement member from said disengaged position to said engaged position when said stud moves from said at least one second position to said at least one first position.

Through this arrangement, the stud moves the disengagement member by means of the actuating arm from the engaged position to the disengaged position and/or the stud moves the disengagement member by means of the second flexible arm from the disengaged position to the engaged position.

According to an embodiment, the timepiece mechanism comprises at least one pin; said at least one actuating arm being configured to come into abutment against said at least one pin so that when said intermediate wheel is driven by said first wheel or by said second wheel, the intermediate wheel and said first wheel and/or the intermediate wheel and said second wheel are in contact at their respective pitch circles Through this arrangement, the intermediate wheel, said first wheel and/or said second wheel is or are in contact at their respective pitch circles.

According to an embodiment, said first wheel and/or said second wheel comprises or comprise a friction surface and a guide member configured to guide said at least one holding member into contact with said friction surface and preferably with said toothing and/or said peripheral surface of said first wheel and/or of said second wheel Through this arrangement, the holding member is guided to the friction surface and preferably to the toothing and/or the peripheral surface. According to an embodiment, said first wheel and/or said second wheel comprises or comprise a reservoir configured to contain a lubricant for lubricating when said at least one holding member is in contact with said friction surface and preferably with said toothing and/or said peripheral surface of said first wheel and/or of said second wheel.

Through this arrangement, wear of the member and of the friction surface and preferably of said toothing and/or the peripheral surface is minimised.

According to an embodiment, said at least one holding member is tangential with and/or matches the shape of said friction surface and preferably of said toothing and/or of said peripheral surface of said first wheel and/or said second wheel.

Through this arrangement, the contact between the holding surface and the holding member is either a point, line or surface contact.

According to an embodiment, said movement plane forms an angle of between 0° and 10°, in particular between 0° and 7° and preferably between 0° and 5° with said first wheel and/or said second wheel.

Through this arrangement, it is possible to disengage in a plane.

BRIEF DESCRIPTION OF THE FIGURES

The invention will be described below in more detail using the attached drawings, given by way of example and in no way limiting, in which.

DETAILED DESCRIPTION OF THE INVENTION

The present invention makes it possible to disconnect a going-train mechanism from a display mechanism for example, and to hold one of the two in place, preferably the display mechanism.

Hence, it may be possible to disconnect the gear train from the going-train mechanism and the gear train from the display mechanism and be able to generate a friction in the displayed mechanism during the disengagement in order, in particular, to hold it in place.

This disengagement may be actuated either by means of the first mechanism, or by a mechanism internal to the movement during the passage of a function.

Figure 1:
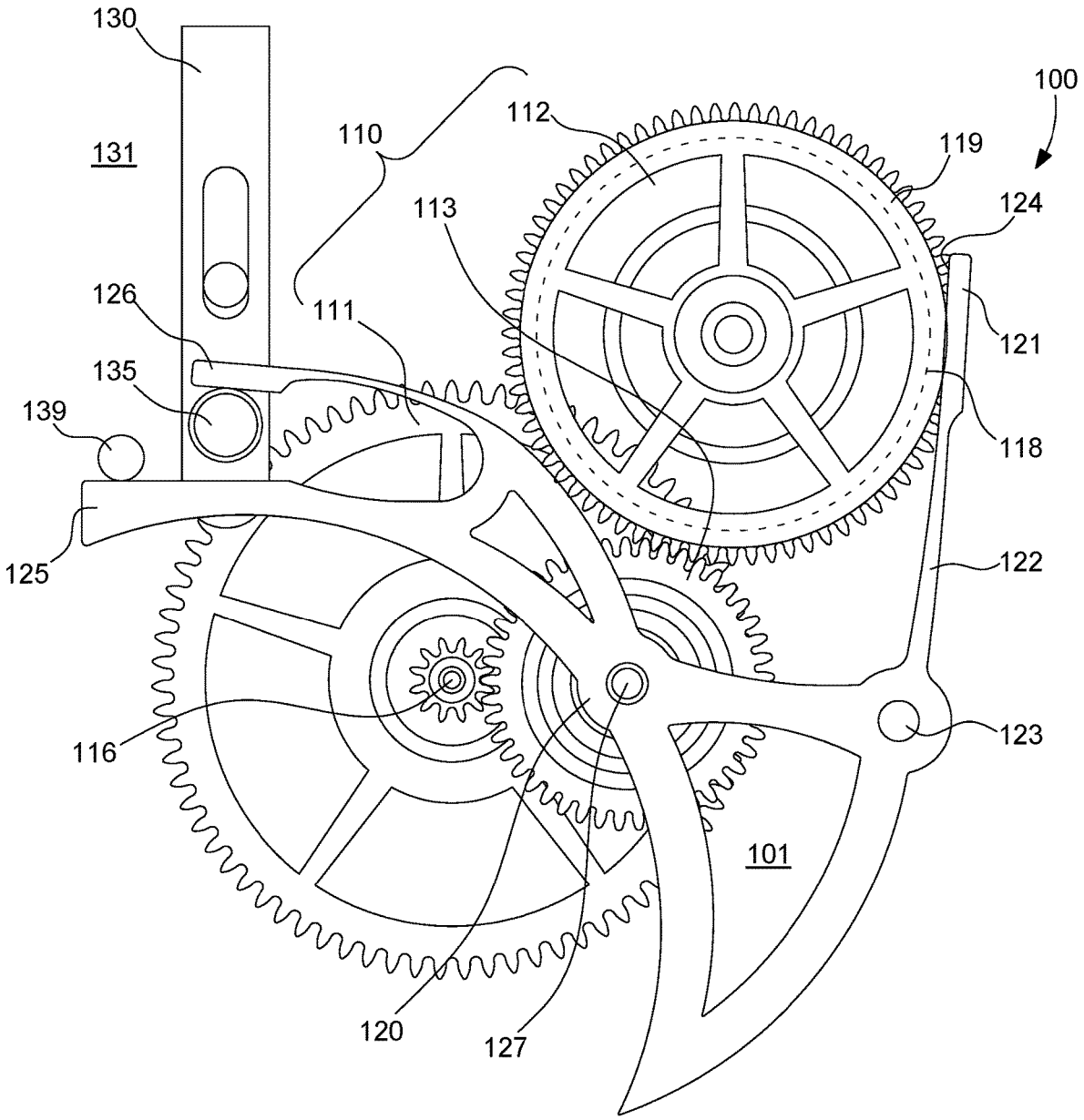
FIG. 1 illustrates a timepiece mechanism in an engaged position.

The present invention, illustrated in FIG. 1, is in the form of a timepiece mechanism 100 configured to disengage a gear train. This timepiece mechanism 100 is composed of a gear set 110, a disengagement member 120, a holding member 121 and a control member 130.

Figure 2:
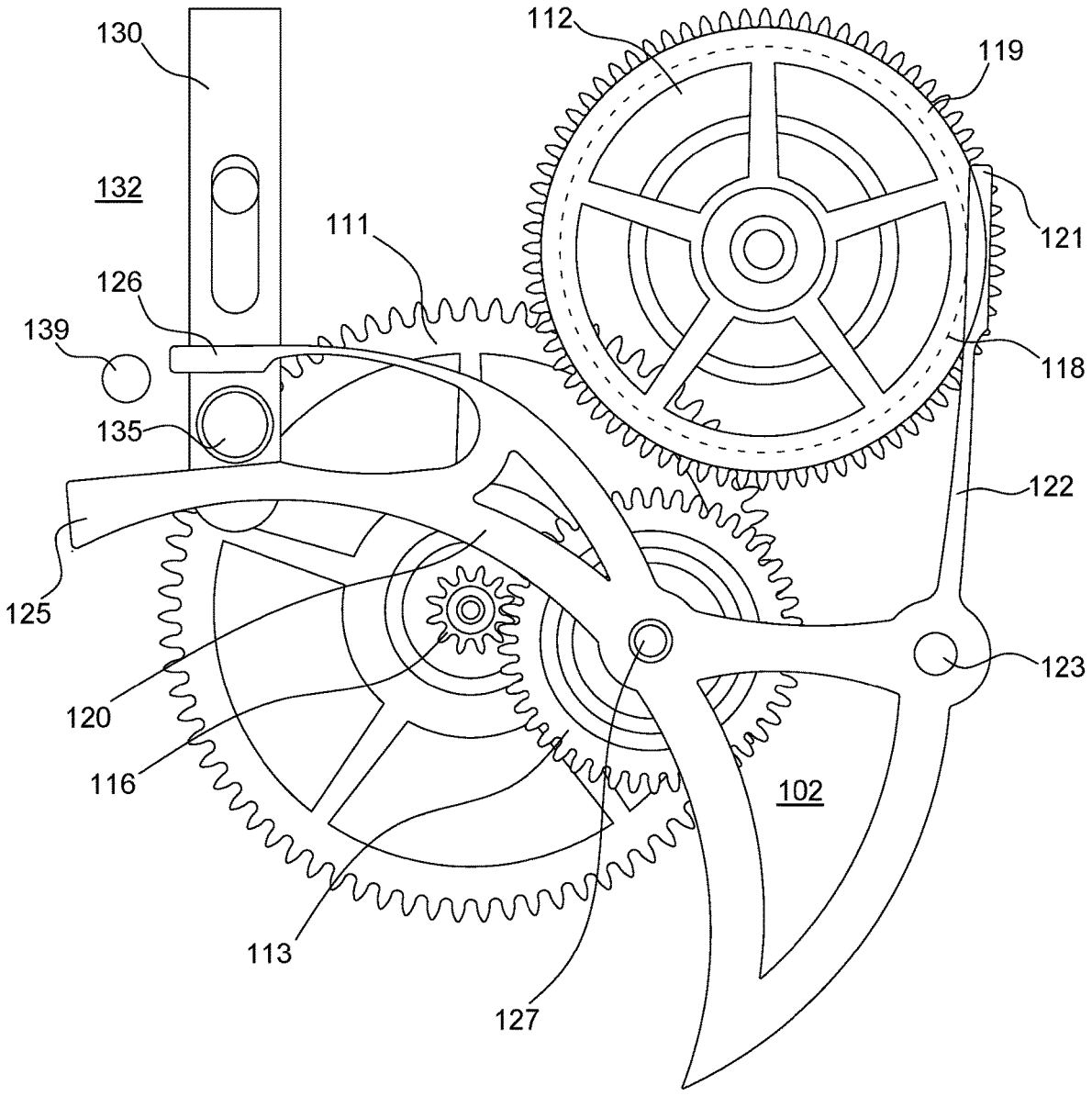
FIG. 2 shows a timepiece mechanism in a disengaged position.

As can be seen in FIGS. 1 and 2, the gear set 110 comprises a first wheel 111 which may be a first disc 111 or a first wheel 111 comprising a first pinion 116, a second wheel 112 which may be a second disc 112 or comprising at least one second pinion, and an intermediate wheel 113.

This intermediate wheel 113 may be arranged between the first wheel 111 and the second wheel 112. According to the embodiments, the intermediate wheel 113 can be arranged between the first disc 111 and the second disc 112 or the second pinion or between the second disc 112 and the first disc 111 or the first pinion 116.

In these configurations, the intermediate wheel 113 may be driven by or may drive the first wheel 111 and/or said second wheel 112 and by extension, the first disc 111 or the first pinion 116, and/or the second disc 112 or the second pinion according to the embodiments, so as to transmit the movement to the intermediate wheel 113 and preferably the rotary movement to the intermediate wheel 113. Indeed, as can be seen in FIGS. 1 and 2, the first wheel 111 and/or the second wheel 112 may be a disc of the going-train mechanism or a display disc, and the intermediate wheel 113 may be a return disc in contact with the disc of the going-train mechanism and the display disc or with their respective pinions.

To this is added a disengagement member 120 configured to move the intermediate wheel 113 in a movement plane between an engaged position 101, as shown by the embodiment illustrated in FIG. 1, in which said first wheel 111, said intermediate wheel 113 and said second wheel 112 are kinematically connected and a disengaged position 102, like that shown in the FIG. 2, in which said intermediate wheel 113 is unmeshed from the second wheel 112, for example. Hence, the intermediate wheel can be in motion and in contact with the first wheel 111 while being disengaged from the second wheel 112, or vice versa, which then enables the engagement, in other words when the intermediate wheel 113 is brought back into contact with the first wheel 111 or the second wheel 112 to avoid a tooth-to-tooth contact because the intermediate wheel continues to be in motion and therefore reduces the risk of damage to the wheels.

As mentioned above, this timepiece mechanism 100 also comprises a holding member 121 for holding the first wheel 111 and/or the second wheel 112 and, more particularly, the disengagement member 120 can comprise the holding member 121.

In other words, the holding member 121 serves to brake 121 or brakes the first wheel 111 and/or the second wheel 112, according to the embodiments. The first wheel 111 and/or the second wheel 112 can comprise a friction surface 118 and preferably a toothing and/or a peripheral surface. This friction surface 118 is configured to cooperate with the holding member 121.

This brake 121 or, as mentioned above, this holding member 121 can be moved by a control member 130 into contact with the first wheel 111 and/or with the second wheel 112 and serves to hold the first wheel 111 and/or the second wheel 112 in position, in other words immobile, when the disengagement member 120 is in the disengaged position 102.

This same control member 130 can also move the disengagement member 120 between the engaged position 101 and the disengaged position 102, by means of an actuating arm 125.

Indeed, the disengagement member 120 comprises an actuating arm 125 by which the control member 130 moves the disengagement member 120 between the engaged position 101 and the disengaged position 102 so as to actuate the disengagement member 120 while being remote from the control member 130. In other words, the control member 130 can be located at the periphery of the plate (not illustrated) and the disengagement member 120 more in the centre or on the other side of the plate.

Hence, it is possible to hold the timepiece mechanism in position while disengaging the watch mechanism so as to allow the time to be set, for example.

Furthermore, the control member 130 comprises a stud 135 and can move between a first position 131 and a second position 132, as can be seen in the figures. This stud 135 is configured to abut and move the actuating arm 125 so as to move the disengagement member 120 from the engaged position 101 to the disengaged position 102 when said stud 135 moves from the first position 131 to the second position 132.

As can be seen in FIGS. 1 and 2, the disengagement member 120 can comprise a first flexible arm 122 able to connect the holding member 121 to the disengagement member 120. More exactly, the first flexible arm 122 is configured to move the holding member 121 into contact with the first wheel 111 and/or with the second wheel 112 so as to bring the holding surface 124 into contact with the first wheel 111 and/or with the second wheel 112. According to the embodiments, the holding member 121 can be tangential with and/or can match the shape of the friction surface 118 and preferably of the toothing and/or the peripheral surface of the first wheel 111 and/or of the second wheel 112 so that the contact between the friction surface 118 and the holding member 121 is either a point, line or surface contact. In the embodiment of FIGS. 1 and 2, it is the second wheel which comprises the friction surface 118.

This first flexible arm 122 can protrude overhanging the disengagement member 120 and can comprise the holding member 121. The first flexible arm 122 can be a return member configured to return the holding member 121 to its position in the manner of a spring or deform elastically according to the embodiment.

Still referring to the figures, the disengagement member 120 is provided with a holding surface 124, and, more particularly, the holding member 121 comprises the holding surface 124. This holding surface 124 can cooperate with the friction surface 118 and preferably with the toothing and/or the peripheral surface of the first wheel 111 and/or of the second wheel 112 so as to produce a friction and/or a lubricated friction with the first wheel 111 and/or the second wheel 112.

According to an embodiment, this friction or this lubricated friction can be fully or partially produced using a combination of the holding member 121 comprising the holding surface 124 and the first flexible arm 122 because, specifically, the first flexible arm 122 will allow the rubbing or friction force to be adjusted in order to hold the first wheel 111 and/or the second wheel 112 and to allow the user to set the time without having to exert too large a force which allows the wear to be minimised and avoids breaking parts. To this effect, a reservoir can optionally be supplied on the first wheel 111 and/or the second wheel 112. This reservoir can be configured to contain a lubricant for lubricating when the holding member 121 is in contact with the friction surface 118 and preferably with the toothing and/or the peripheral surface of the first wheel 111 and/or of the second wheel 112 and hence minimising the wear of the holding member 121 and of the friction surface 118 and preferably of the toothing and/or the peripheral surface.

This reservoir can take the form of a guide member 119 on the first wheel 111 and/or the second wheel 112 so as to guide and/or lubricate said at least one holding member 121 when it is in contact with the friction surface 118 and preferably with the toothing and/or the peripheral surface of said first wheel 111 and/or of said second wheel 112.

As mentioned above, the holding member 121 is moved into contact with the first wheel 111 and/or with the second wheel 112. This movement is carried out by a pivoting or rocking of the disengagement member 120 about a pivot axis 123.

Indeed, the disengagement member 120 is configured to pivot about the pivot axis 123 so as to move between said engaged position 101 and said disengaged position 102, which allows the holding member 121 to move into contact with said friction surface 118 and according to a certain embodiment, the disengagement member 120 may be a lever 120.

During this pivoting or rocking, the intermediate wheel 113, being arranged on the disengagement member 120, is preferably mounted to pivot on a return axis 127 which can be separate and/or remote from the pivot axis 123. Indeed, according to an embodiment (not illustrated), the disengagement member 120 can comprise a sliding pinion mounted on the pivot axis so that the pivot axis and the return axis are on the one hand coincident and on the other hand so that when the disengagement member 120 moves from the engaged position to the disengaged position, the sliding pinion pivots at the same time as the disengagement member 120 and is accompanied by a downward or upward translational movement so that the intermediate wheel 113 is no longer in contact with the first wheel 111 and/or the second wheel 112.

Thus, independently of the fact that the return axis 127 is separate or coincident with the pivot axis 123, the intermediate wheel 113 can be moved between said engaged position 101 and said disengaged position 102 when the disengagement member 120 is moved.

According to another embodiment, the intermediate wheel 113 is arranged between said pivot axis 123 and the actuating arm 125. An advantage of this arrangement is that it allows the intermediate wheel 113 to remain in motion and/or in contact with the first wheel 111 while being disengaged from the second wheel 112, or vice versa. Hence, when the disengagement member 120 moves from the disengaged position 102 to the engaged position 101, the movement of the wheel associated with the disengagement member 120 reduces the risk of having a tooth-on-tooth contact because, on the one hand, the wheel moves in a plane, making an angle of between 0° and 10°, in particular between 0° and 7° and preferably between 0° and 5° with the first wheel 111 and/or the second wheel 112, and on the other hand it remains in motion. Therefore, when the intermediate wheel 113 returns to the engaged position 101, more exactly when the disengagement member 120 moves to the engaged position 101, the intermediate wheel 113 continues its rotation about the return axis 127 and meshes with the first wheel 111 or the second wheel 112.

Furthermore, the disengagement member 120 optionally comprises a second flexible arm 126 configured to move the disengagement member 120 from the disengaged position 102 to the engaged position 101 when the control member 130, and by extension the above-mentioned stud 135, moves from the second position 132 to the first position 131. More particularly, this second flexible arm 126 can deform elastically and hence move the intermediate wheel 113 in a more flexible manner to the engaged position 101.

Finally, the timepiece mechanism 100 can comprise a pin 139 so that when the actuating arm 125 abuts against this pin 139 in the first position 131 or in the engaged position 101, the intermediate wheel 113 and at least one of the first or second wheels 111, 112, is in contact at their respective pitch circles so that the transmission of the movement is optimal.

In summary, FIG. 1 illustrates the control member 130 pulling the disengagement member 120 by means of the stud 135 which stresses the second flexible arm 126 of the disengagement member 120.

The disengagement member 120 abuts against the pin 139 and comprises the intermediate wheel 113, also called the return wheel 113, which meshes with the disc of the second wheel 112. The holding member 121 of the disengagement member 120 is not in contact with the friction surface 118 and preferably with the toothing and/or the peripheral surface. Hence, the first wheel 111 drives the second wheel 112 by means of the intermediate wheel 113.

In FIG. 2, the control member 130 is moved and the stud 135 loses its contact with the second flexible arm 126 and comes into contact with the actuating arm 125 of the disengagement member 120 which rotates it. The return 113 remains meshed with the pinion of the first wheel 111 but unmeshed with the second wheel 112. The holding member 121 comes into contact with the friction surface 118 and preferably with the toothing and/or the peripheral surface by means of the holding member 121 which holds the second wheel 112 in place, to the nearest gear.

Hence, the first wheel 111 continues to turn and the second wheel 112 is stopped and held by the disengagement member 120 via the holding member 121.

The invention claimed is:

1. A timepiece mechanism (100) for disengaging a gear train, said timepiece mechanism (100) comprising at least:

at least one gear set (110) comprising a first wheel (111), a second wheel (112) and an intermediate wheel (113) arranged between said first wheel (111) and said second wheel (112); said intermediate wheel (113) being configured to be driven by or for driving said first wheel (111) and/or said second wheel (112);

at one disengagement member (120) configured to move said intermediate wheel (113) in a movement plane between an engaged position (101) in which said first wheel (111), said intermediate wheel (113) and said second wheel (112) are kinematically connected and a disengaged position (102) in which said intermediate wheel (113) is unmeshed from said first wheel (111) and/or from said second wheel (112);

at least one holding member (121) configured to hold said first wheel (111) and/or said second wheel (112); and at least one control member (130) configured to move said at least one disengagement member (120) between said engaged position (101) and said disengaged position (102) and to move said at least one holding member (121) into contact and to hold said first wheel (111) and/or said second wheel (112) when said at least one disengagement member (120) is in the disengaged position (102), wherein said at least one disengagement member (120) comprises at least one first flexible arm (122) configured to connect said at least one holding member (121) to said at least one disengagement member (120), wherein said first wheel (111) and/or said second wheel (112) comprises a friction surface (118), wherein said at least one holding member (121) has a holding surface (124) configured to cooperate with said friction surface (118) of said first wheel (111) and/or said second wheel (112), wherein the holding of said first wheel and/or of said second wheel by said holding surface is performed by friction or lubricated friction allowing the user a manual correction in the disengaged position (102), and wherein said at least one control member is slidably movable in translation between a first position and a second position to move said at least one disengagement member (120) between said engaged position (101) and said disengaged position (102) and to move said at least one holding member (121) into contact and to hold said first wheel (111) and/or said second wheel (112) when said at least one disengagement member (120) is in the disengaged position (102).

2. The timepiece mechanism (100) according to claim 1, wherein said first wheel (111) is a first disc (111) or comprises at least one first pinion (116) and/or said second wheel (112) is a second disc (112) or comprises at least one second pinion; said at least one first pinion (116) and/or said at least one second pinion being configured to or are configured to drive said intermediate wheel (113).

3. The timepiece mechanism (100) according to claim 1, wherein said at least one disengagement member (120) comprises at least one actuating arm (125); said at least one control member (130) is configured to move said at least one disengagement member (120) by means of said at least one actuating arm (125).

4. The timepiece mechanism (100) according to claim 3, wherein said intermediate wheel (113) is arranged between said pivot axis (123) and said at least one actuating arm (125).

5. The timepiece mechanism (100) according to claim 3, comprising at least one pin (139); said at least one actuating arm (125) being configured to come into abutment against said at least one pin (139) so that when said intermediate wheel (113) is driven by said first wheel (111) or by said second wheel (112), the intermediate wheel (113) and said first wheel (111) and/or the intermediate wheel (113) and said second wheel (112) are in contact at their respective pitch circles.

6. The timepiece mechanism (100) according to claim 1, wherein said at least one first flexible arm (122) is configured to move said at least one holding member (121) into contact with the first wheel (111) and/or with the second wheel (112).

7. The timepiece mechanism (100) according to claim 1, wherein said at least one first flexible arm (122) is configured to deform elastically.

8. The timepiece mechanism (100) according to claim 1, wherein said at least one disengagement member (120) is mounted to pivot about a pivot axis (123).

9. The timepiece mechanism (100) according to claim 8, wherein said at least one disengagement member (120) is configured to pivot about said pivot axis (123) so as to move between said engaged position (101) and said disengaged position (102).

10. The timepiece mechanism (100) according to claim 1, wherein said intermediate wheel (113) is arranged on said at least one disengagement member (120) and is mounted to pivot on a return axis (127).

11. The timepiece mechanism (100) according to claim 1, wherein said first wheel (111) and/or said second wheel (112) comprises or comprise a friction surface (118) and a toothing and/or a peripheral surface, and a guide member (119) configured to guide said at least one holding member (121) into contact with said friction surface (118) and with said toothing and/or said peripheral surface of said first wheel (111) and/or of said second wheel (112).

12. The timepiece mechanism (100) according to claim 1, wherein said at least one holding member (121) is tangential with and/or matches the shape of said friction surface (118) and of said toothing and/or of said peripheral surface of said first wheel (111) and/or of said second wheel (112).

13. The timepiece mechanism (100) according to claim 1, wherein said movement plane forms an angle of between 0° and 10° with said first wheel (111) and/or said second wheel (112).

14. A timepiece mechanism (100) for disengaging a gear train, said timepiece mechanism (100) comprising at least:

at least one gear set (110) comprising a first wheel (111), a second wheel (112) and an intermediate wheel (113) arranged between said first wheel (111) and said second wheel (112), said intermediate wheel (113) being configured to be driven by or for driving said first wheel (111) and/or said second wheel (112);

at one disengagement member (120) having at least one actuating arm, said at least one disengagement member (120) being configured to move said intermediate wheel (113) in a movement plane between an engaged position (101) in which said first wheel (111), said intermediate wheel (113) and said second wheel (112) are kinematically connected and a disengaged position (102) in which said intermediate wheel (113) is unmeshed from said first wheel (111) and/or from said second wheel (112);

at least one holding member (121) configured to hold said first wheel (111) and/or said second wheel (112); and at least one control member (130) configured to move said at least one disengagement member (120) between said engaged position (101) and said disengaged position (102) and to move said at least one holding member (121) into contact and to hold said first wheel (111) and/or said second wheel (112) when said at least one disengagement member (120) is in the disengaged position (102), wherein said at least one disengagement member (120) comprises at least one first flexible arm (122) configured to connect said at least one holding member (121) to said at least one disengagement member (120), and wherein said at least one control member (130) is configured to move between at least one first position (131) and at least one second position (132) and comprising a stud (135); said stud (135) being configured to abut and move said at least one actuating arm (125) so as to move said at least one disengagement member (120) from said engaged position (101) to said disengaged position (102) when said stud (135) moves from said at least one first position (131) to said at least one second position (132) and/or wherein said at least one disengagement member (120) comprises at least one second flexible arm (126); said at least one second flexible arm (126) being configured to move said at least one disengagement member (120) from said disengaged position (102) to said engaged position (101) when said stud (135) moves from said at least one second position (132) to said at least one first position (131).

* * * * *